United States Patent [19]

Debiase et al.

[11] 4,322,060

[45] Mar. 30, 1982

[54] QUENCH TANK STEERING ROLL ASSEMBLY

[75] Inventors: Bennet W. Debiase, Orange; Harold W. Ryder, Hamden; Pasquale Silvestri, New Haven; John M. Whalen, Ansonia, all of Conn.

[73] Assignee: Olin Corporation, New Haven, Conn.

[21] Appl. No.: 44,181

[22] Filed: May 31, 1979

[51] Int. Cl.[3] ..... C21D 11/00

[52] U.S. Cl. ..... 266/89; 266/102; 266/112

[58] Field of Search ..... 266/102, 103, 104, 108–113, 266/89; 148/156, 153

[56] References Cited

U.S. PATENT DOCUMENTS 4,160,677 7/1979 Lukac et al. ..... 148/156

*Primary Examiner*—R. Dean

*Attorney, Agent, or Firm*—Howard M. Cohn; Paul Weinstein

[57] ABSTRACT

A method and apparatus are disclosed for steering and treating continuously running strip material. The strip material is directed by a steering assembly having a steering roll mounted to a yoke. The strip material is passed over a portion of the roll surface and is steered by pivoting the yoke so that the roll axis is caused to rotate or tilt in a plane transverse to the plane formed by the running strip material.

33 Claims, 14 Drawing Figures

QUENCH TANK STEERING ROLL ASSEMBLY

BACKGROUND OF THE INVENTION

For years it has been common practice to continuously pass strip material through furnaces after which the strip is fed through a quench tank. During such processes it has been common practice to pass the strip over a roll mounted within the quench tank.

It is well known that such metal or alloy strip material often has a camber and/or lateral curvature associated therewith due to the rolling operations used in forming such strip. In the absence of a steering mechanism associated with the quench tank roll the strip would have a tendency to move across the face of the roll and eventually jamb up against the walls of the quench tank. This of course would lead to severe damage of the quenching apparatus causing equipment down time as well as leading to damage and/or loss of the strip material itself.

This invention relates to a method and apparatus for efficiently and quickly centering and aligning moving objects, especially strip and strip-like materials.

PRIOR ART STATEMENT

It is known in conventional quench tanks to rigidly mount both ends of a roll to the tank walls while providing hydraulic jacks in all four corners of the quench tank. When it is desired to steer the metal or alloy strip the roll is tilted by actually jacking the selected various corners of the tank up or down. One of the problems often encountered in this particular steering system is the fact that the hydraulic jacks may leak permitting the tank corners to creep back down again. In addition, the quench tank is kept hot as a result of the hot water contained therein and the stresses set up in the quench tank eventually lead to the punching of holes by the jacks in the tank bottom. This particular problem poses a danger in that nearby workers can be burned by any escaping hot water. Working with such a multiple jack system leads to quite long set up times and strip steering correction times. The metal or alloy strip must be run very slowly since the jacks are adjusted in all four corners of the tank, and this slow run is maintained until the strip is at least positioned on a takeup or steering roll located outside the quench tank. Once the strip is set up in such manner it would then be possible to speed up again.

In another known conventional quench tank arrangement one end of a steering roll is rigidly mounted to a quench tank wall while the other end of the roll is free to be raised or lowered by a jack arrangement. Typically, a worker can turn a hand crank which via such a jack would raise or lower the movable end of the roller thereby steering the metal or alloy strip.

Both of the jack systems described above are slow and laborious. Camber in rolled metal and alloy strips tends to require almost constant adjustment and must be continuously compensated for. In addition, such jack systems do not lend themselves readily to any kind of automatic edge guide control since it is extremely difficult to get a jack which is sensitive enough to get it to automatically and quickly steer the strip as desired.

Various other means for centering and steering metal or alloy strip over rolls have been described in the prior art. U.S. Pat. Nos. 2,592,581, 2,706,625, and 2,822,169 to Lorig show strip rolls having various specific surface contours for centering and controlling strip material. In addition to surface contour U.S. Pat. No. 2,592,581 to Lorig shows a flexible surface while U.S. Pat. Nos. 2,822,169 and 2,706,625 also depict segmented roller surfaces.

In yet another type of strip steering mechanism, U.S. Pat. No. 3,692,223 to Laigle et al. described a plate and guide bar arrangement which carefully guides strip material in a precise position.

The aforementioned particular types of control means are not suitable for quench tank applications for several reasons. Because the quench tank is located immediately adjacent the furnace to provide a water seal preventing oxidation by atmospheric contact there must be provided a steering roll or mechanism which will work in a tank of water. There is by definition therefore, a minimum of available space and a hostile environment. Typically, such an environment includes the presence of hot water and various oxides. In such an environment and confined space known steering mechanisms as discussed supra and others, such as axis mounted traversing slide rolls, are simply not suitable.

All prior art patents disclosed and discussed herein are hereby incorporated by reference.

SUMMARY OF THE INVENTION

In accordance with this invention, an improved strip steering mechanism is disclosed which is readily adaptable to be used in conjunction with conventional strip treating apparatus, and in particular in quench tanks. The steering mechanism overcomes problems caused by camber in the metal or alloy strip put in during rolling processes.

It has been found in accordance with this invention that highly effective steering of strip can be accomplished by mounting a steering roll to a pivotable yoke. When the roll is mounted in such a way it is possible to tilt the entire roll, raising or lowering both ends thereof, by simply pivoting the yoke.

The yoke requires very little room beyond the outside measurements of the roll, and can be serviced even when the roll itself is in a hostile environment, such as in the hot water of a quench tank.

In another aspect of the present invention the aforementioned steering mechanism is activated by a center guide assembly and control system in such a manner that the strip material can be maintained in a desired center line position continuously and automatically without regard to different strip widths and manual adjustments.

The steering mechanism of this invention possesses certain advantages over conventional steering mechanisms in that it is readily adaptable to quick manual and automatic controls, such as those disclosed in copending U.S. application Ser. No. 44,182, now U.S. Pat. No. 4,218,002, filed on even date herewith and assigned to the assignee herein, the disclosure of which is herein incorporated by reference, it can be adjusted more quickly at far higher strip line speeds, it has twice the control of prior art steering rolls that pivot only about one end, it takes only a small amount more of space than a rigidly mounted roll, and it is characterized by a faster response than jack operated prior art steering rolls.

Accordingly, it is a principal object of the present invention to provide an efficient steering mechanism for steering of strip material.

It is a further object of the present invention to provide a steering mechanism which is particularly suitable for use in a hostile environment.

It is still a further object of the present invention to provide a steering mechanism for strip material which is particularly suitable for use in limited access or limited space area.

Other objects and advantages will become apparent to those skilled in the art from a consideration of the description which proceeds with reference to the following drawings.

DETAILED DESCRIPTION OF THE PREFERRED EMBODIMENTS

In accordance with the present invention, the foregoing objects and advantages are readily attained.

The method of this invention comprises passing strip material over a steering roller which is mounted to a pivotable yoke. When it is desired to adjust the strip from side to side the yoke is pivoted a selected amount and direction causing the roller to tilt and the strip material to move laterally to a desired position.

Figure 1:
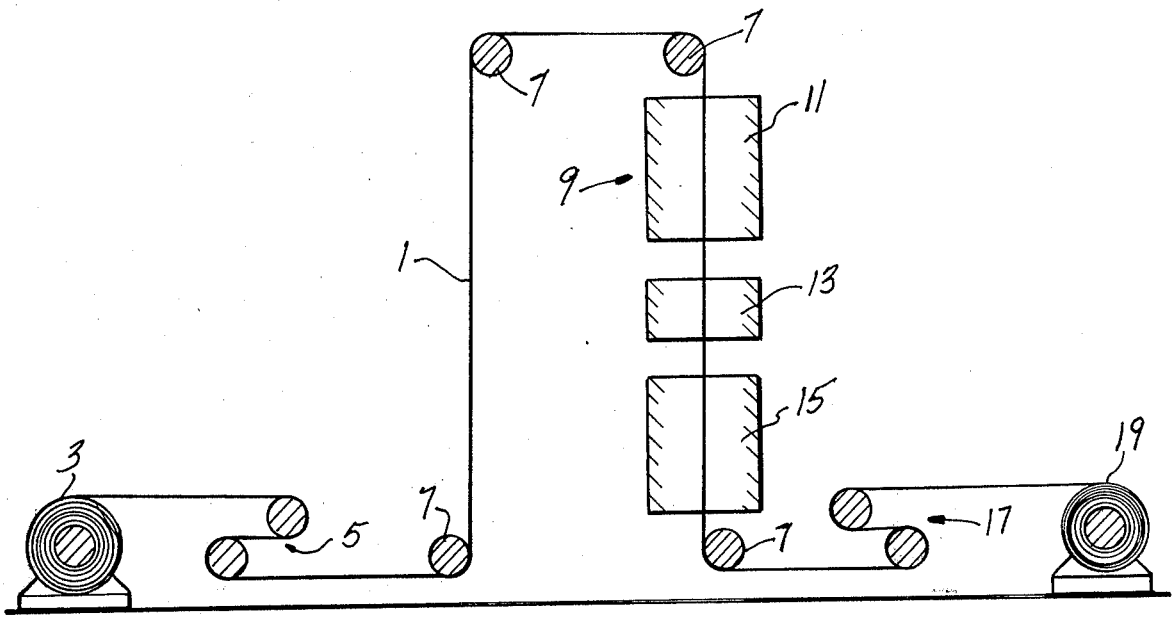
FIG. 1 is a schematic view in side elevation of a typical process line which could employ the steering mechanism of this invention.

A typical process line on which the principals of the present invention might be employed is shown in FIG. 1. A metal strip 1 which is to be treated is unwound from a roll 3. The strip is treaded thorugh wrapped roll bridal 5 which controls the entry and line speed of the strip. Various rolls 7, including top entry and exit rolls, are provided as shown to set the path of the strip through the furnace 9. At the entry end of the furnace is a heating zone 11 through which the metal strip passes. The strip next passes through a holding zone 13, and from there it passes through cooling zone 15. Upon emerging from the furnace the strip passes through exit wrap bridal 17. After treatment the strip is recoiled on motorized reel 19.

Figure 2:
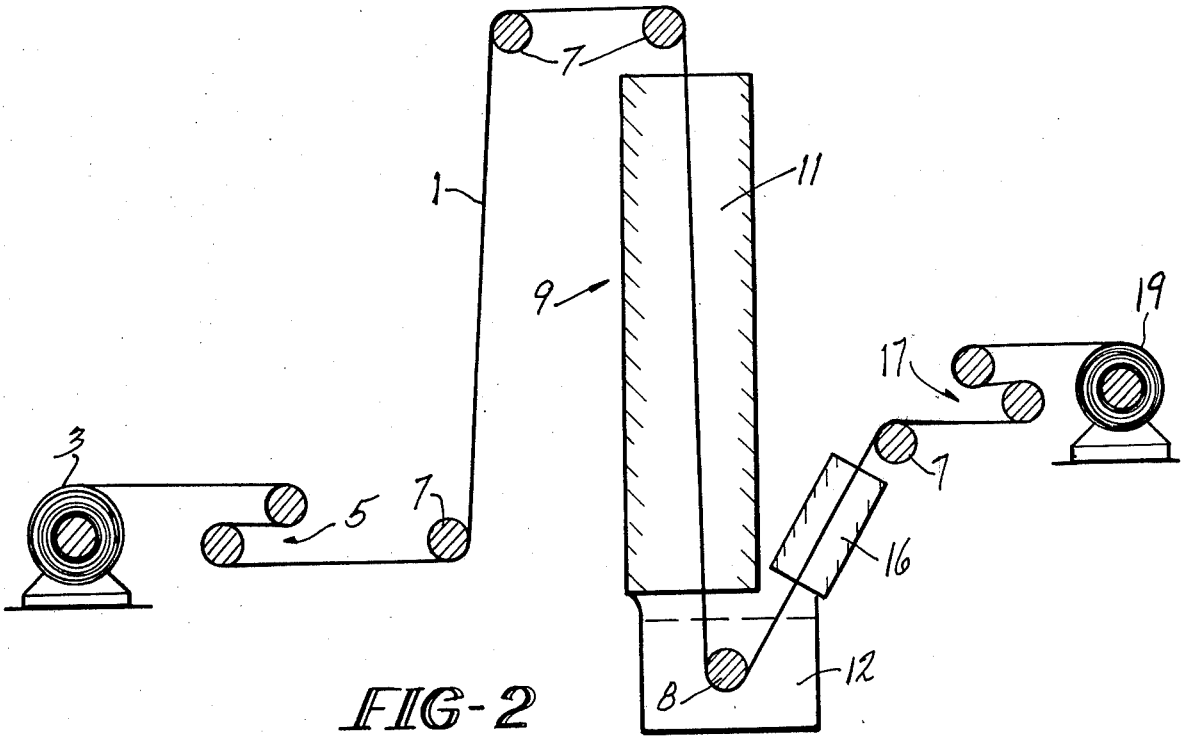
FIG. 2 is a schematic view in side elevation of a typical process line having a quench tank therealong which could preferably employ the steering mechanism of this invention.

FIG. 2 shows another typical process line on which the principals of the present invention can be employed.FIG. 2 is similar to FIG. 1 and like parts are designated by like numerals used in FIG. 1. A furnace 9 is depicted in FIG. 2 having a heating zone 11. The heated strip passes from heating zone 11 directly into quench tank 12 around steering roll 8 and then through hot air dryer 16. Upon emerging from dryer 16 the strip passes over roll 7 through exit wrap bridal 17 and is recoiled as in FIG. 1.

In the processes of FIG. 1 and FIG. 2 the steering mechanism of this invention could be used with any of the rolls 7 depicted therein. However, in its preferred form, the steering mechanism of this invention is utilized in conjunction with quench tank steering roll 8, depicted in FIG. 2.

Figure 3:
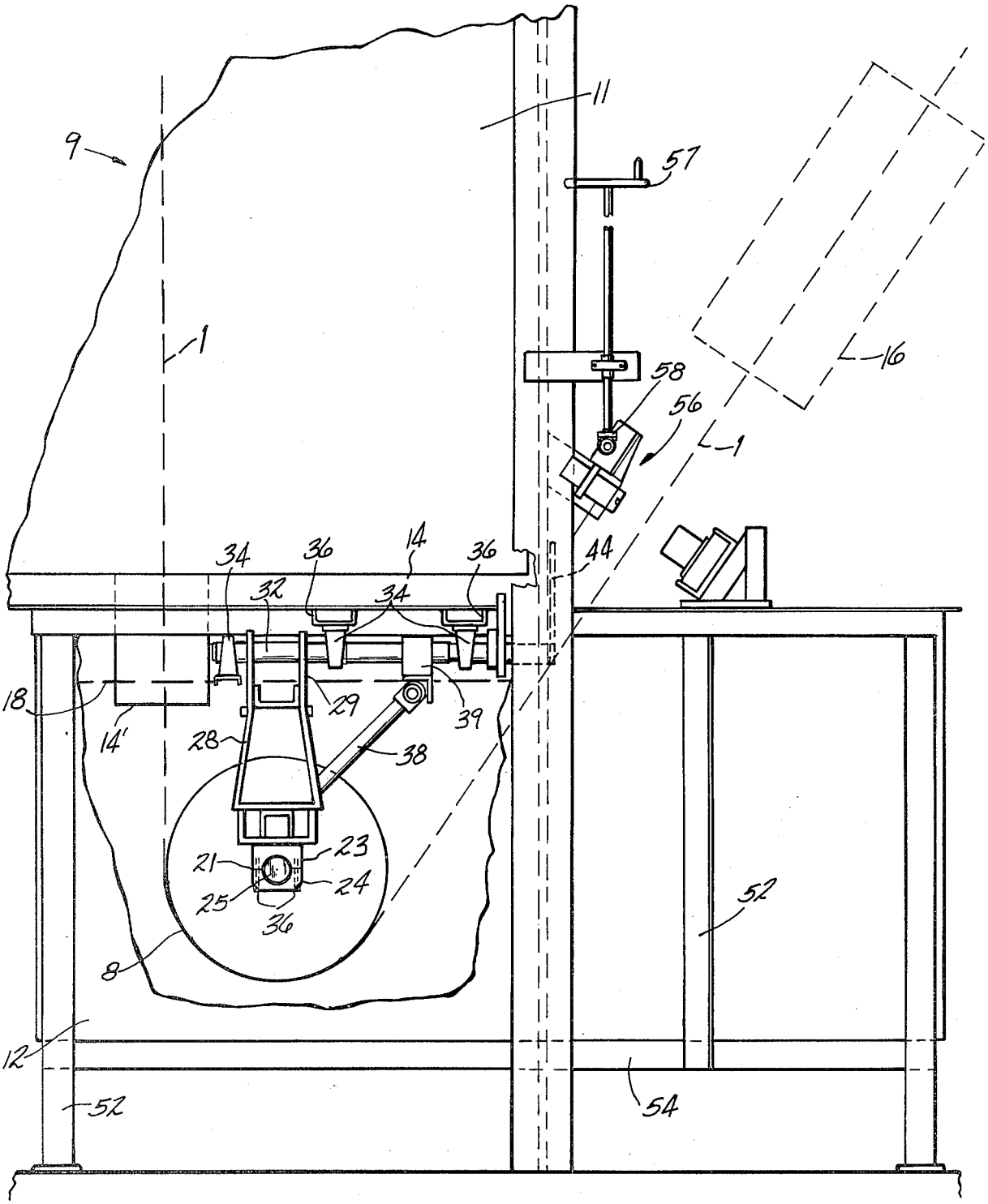
FIG. 3 is a side view of a steering mechanism employing the principals of the present invention.
Figure 4:
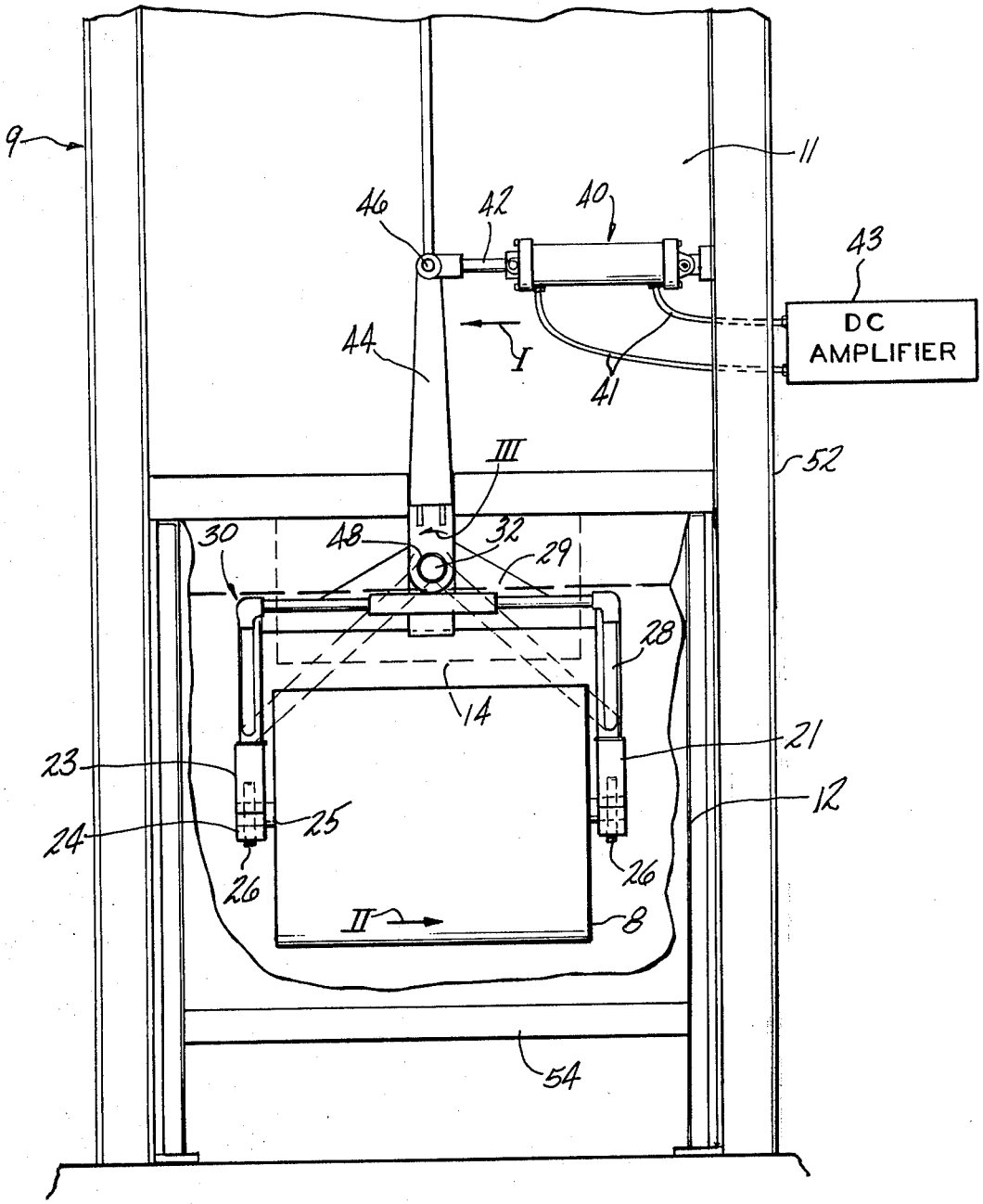
FIG. 4 is a front view of the steering mechanism of the present invention showing a means for activating the steering mechanism.

FIGS. 3 and 4 illustrate a steering mechanism associated with a continuous strip furnace-quench tank arrangement employing the principles of the present invention. Furnace 9 comprises heating zone 11 having a floor 14 and a throat 14' which projects therefrom into quench tank 12. During operation of the process throat 14' extends beneath the surface 18 of the cooling fluid located in quench tank 12. This arrangement provides a sealed atmosphere via a water seal so as to prevent oxidation of the metal strip 1 as it passes from heating zone 11 into quench tank 12. The quenched strip is normally passed through a hot air dryer 16 prior to being recoiled.

Referring to FIGS. 3 and 4 steering roll 8 is shown mounted to split bearing block 21. Split bearing block 21 comprises upper and lower portions 23 and 24 respectively. Shaft 25 of steering roll 8 is shown clamped within split bearing block 21 and is secured therein by threaded bolts 26. In the embodiment of FIGS. 3 and 4 steering roll 8 is rotatable about shaft 25 via internal bearings (not shown) while shaft 25 is rigidly clamped within split bearing block 21. It would of course be possible to use a roll rigidly secured to shaft 25 which shaft in turn could be rotatable within a split bearing block 21 provided with a bearing therein.

Split bearing blocks 21 are attached to lower suspension portions or arms 28 of the yoke 30 which are in turn attached to or integral with upper suspension portion 29 of the yoke 30. Yoke 30 is rigidly secured via upper suspension portion 29 to pivot shaft 32 by known means such as welds, keyways, etc. Pivot shaft 32 is rotatably mounted within pillow block bearings 34 which are secured to channel irons 36. Channel irons 36 run across the top of quench tank 12. Outrigger 28 is provided (FIG. 3) to provide additional support and strain relief to steering roll 8 and may be secured by any suitable means, such as for example welding to the lower ends of suspension portions 28 and utilizing sleeve 39 for attachment to pivot shaft 32 respectively.

Referring now to FIG. 4 there is shown therein a hydraulic cyliner 40 having a cylinder shaft or piston arm 42 extending therefrom. A pivot arm 44 is clevis mounted at 46 in piston arm 42 and is rigidly mounted in any suitable way, such as by welding or keyway, etc., at the other end 48 to pivot shaft 32. Hydraulic cylinder 40 and pivot arm 44 may be located in any convenient position along the length of pivot shaft 32, which shaft itself may be of any desired convenient length.

Support for various furnace structures is provided by vertical I-beam supports 52 and horizontal channel irons 54 in standard fashion.

Referring again to FIG. 3 there is shown therein an edge detector 56 which can be utilized to automatically determine when there is undesirable lateral movement of the strip material. In the embodiment of FIG. 3 a photoelectric detector is shown which can be adjusted via handle 57 and gears 58 for various width strips. Edge detector 56 may be of any known type, for example a mechanical (feeler), pheumatic, or light sensitive variety. Upon detection of undesired strip movement an electric signal could be provided to DC amplifier 43 which would then automatically activate hydraulic cylinder 40 via fluid lines 41.

The operation of the stering mechanism in accordance with this invention is as follows: When the strip 1 begins to move off center in traveling around steering roll 8 it is detected by either visual observance of an operator or by detection via an automatic edge detector 56. In either case a signal is sent to hydraulic cylinder 40 as a result of electrical impulses provided by the operator (activating a switch device) or the edge detector 56 (automatic electrical impulse) whereby cylinder shaft 42 is either extended or shortened. For purposes of this discussion it is assumed that it is desired to adjust the strip in the direction of arrow II in FIG. 4. To accomplish the adjustment cylinder shaft 42 is extended in the direction shown by arrow I causing pivot arm 44 to rotate in the direction shown by arrow III thereby tilting steering roll 8 and moving strip 1 in the direction of arrow II. After the desired adjustment is accomplished cylinder shaft 42 can be returned to approximately its original position or in the case of an automatic control, can be continuously adjusted.

In a preferred embodiment the steering mechanism of this invention is activated by the strip center guide assembly 60 depicted in FIGS. 5 through 14. The center guide assembly 60 provides completely automatic and continuous activation of the steering means without the need for any manual adjustments either before or during strip processing regardless of strip width. As such it is preferred over known edge detectors and photo-electric sensors discussed hereinabove.

Figure 5:
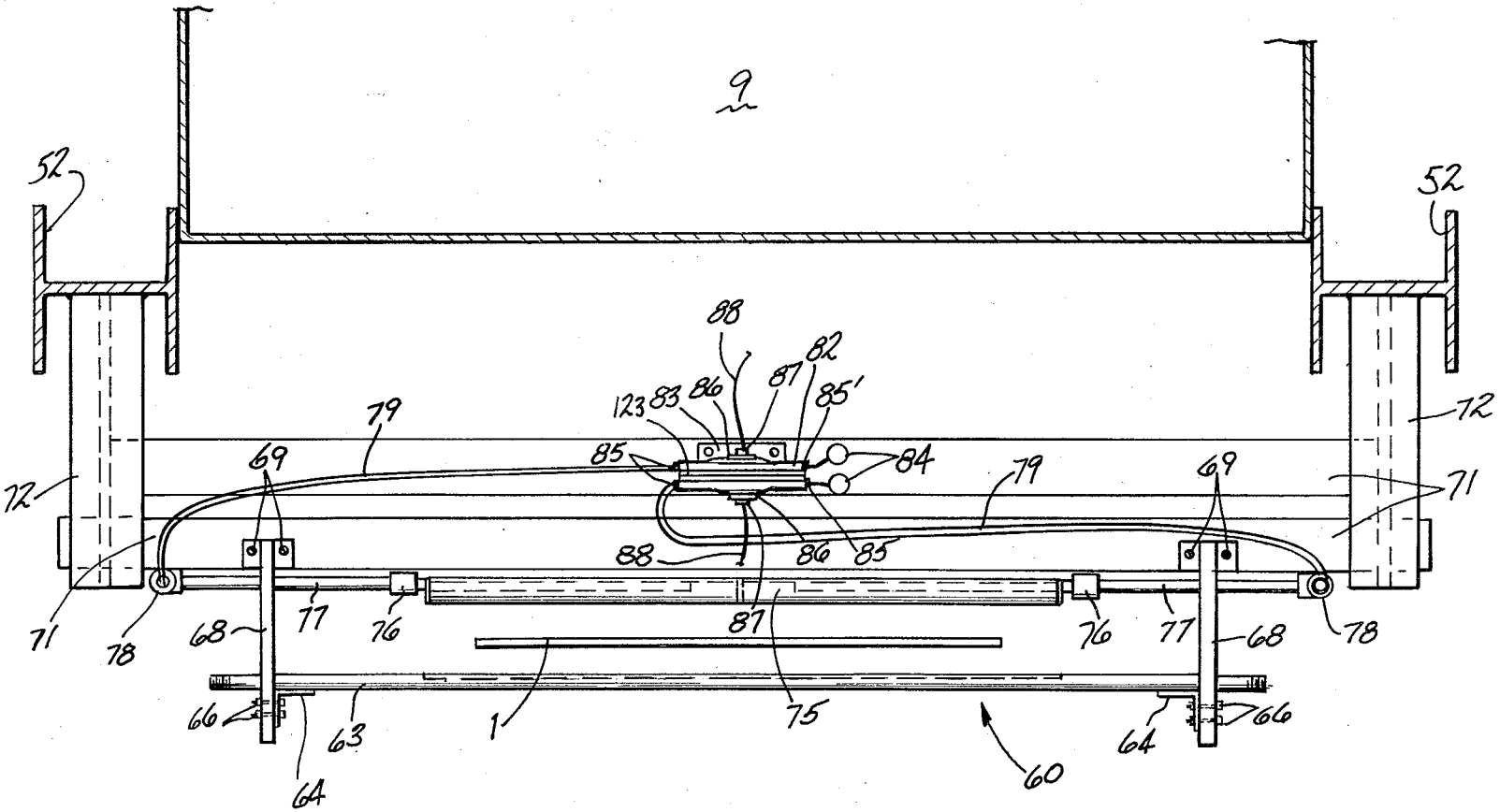
FIG. 5 is a top view of a strip center guide assembly mounted to the support structure of the furnace-quench tank-steering mechanism depicted in FIGS. 3 and 4, showing another means for activating the steering mechanism.
Figure 6:
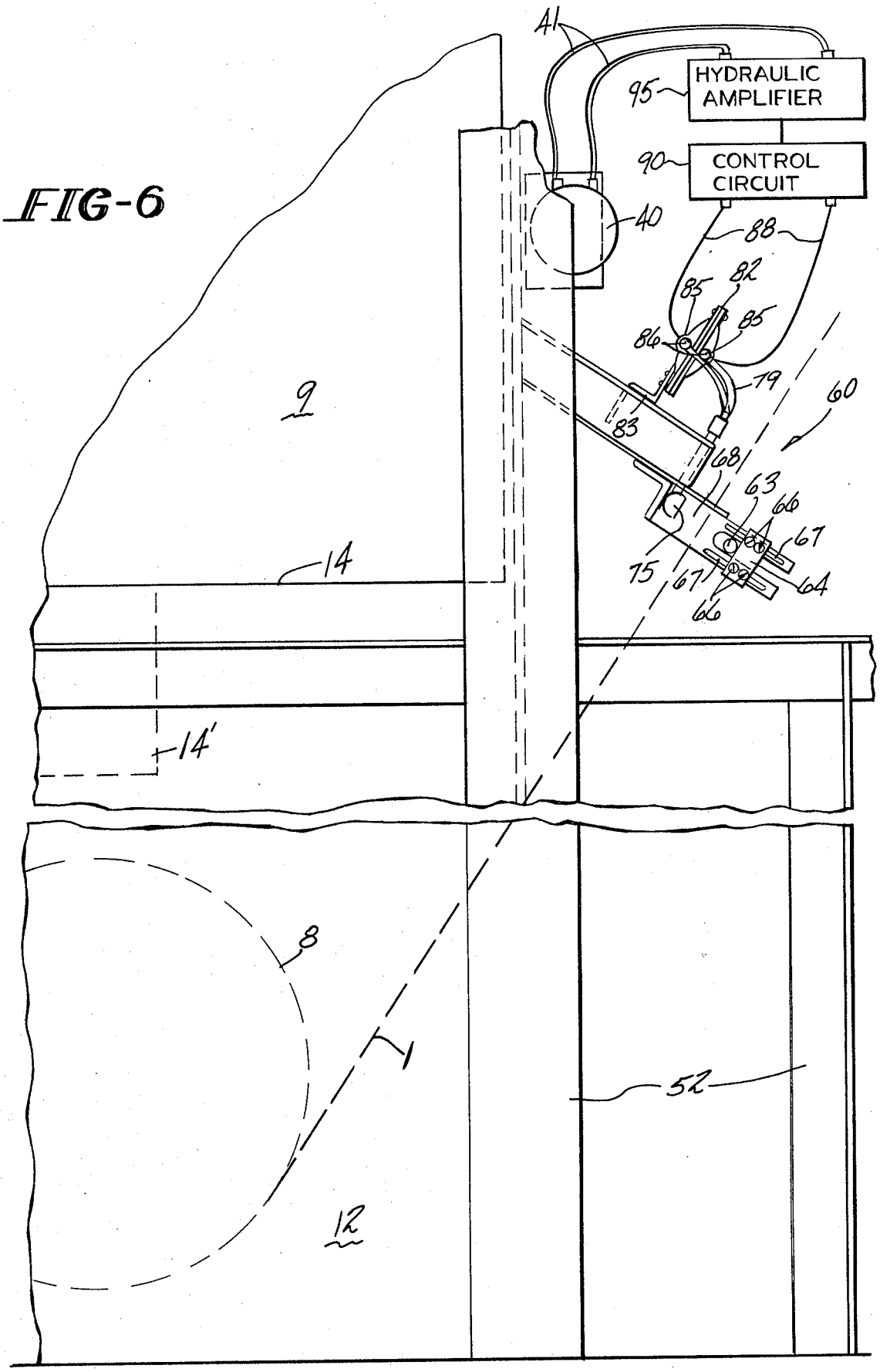
FIG. 6 is a front view of the center guide assembly mounted to the strip treating apparatus of FIG. 5.

FIGS. 5 and 6 illustrate a strip center guide assembly 60 associated with a continuous strip furnace-quench tank arrangement as shown in FIGS. 3 and 4. Furnace 9 is supported by I-beam supports 52. Extending from I-beam supports 52 are structural supports 72 to which are secured cross structural supports 71.

Referring now to FIG. 5, a center guide assembly 60 is shown comprising three primary elements as follows: an air supply element 63, an air pressure pickup element 75, and a sensing device 82. Air supply element 63 is slidably mounted via angle iron supports 64 to unistrut frames 68. Unistrut frames 68 are provided with elongated slots 67 (FIG. 6) for receiving bolts 66 which pass through angle iron supports 64 and thus secure air supply element 63. Loosening of bolts 66 permits for adjustment of the distance between supply element 63 and metal strip 1. The distance between air supply element 63 and air pressure pickup element 75 can also be adjusted in this way. Unistrut frames 68 are shown secured to structural support 71 by bolts 69, but any other suitable means for securing may be used, as for example welding or the like.

Figure 12:
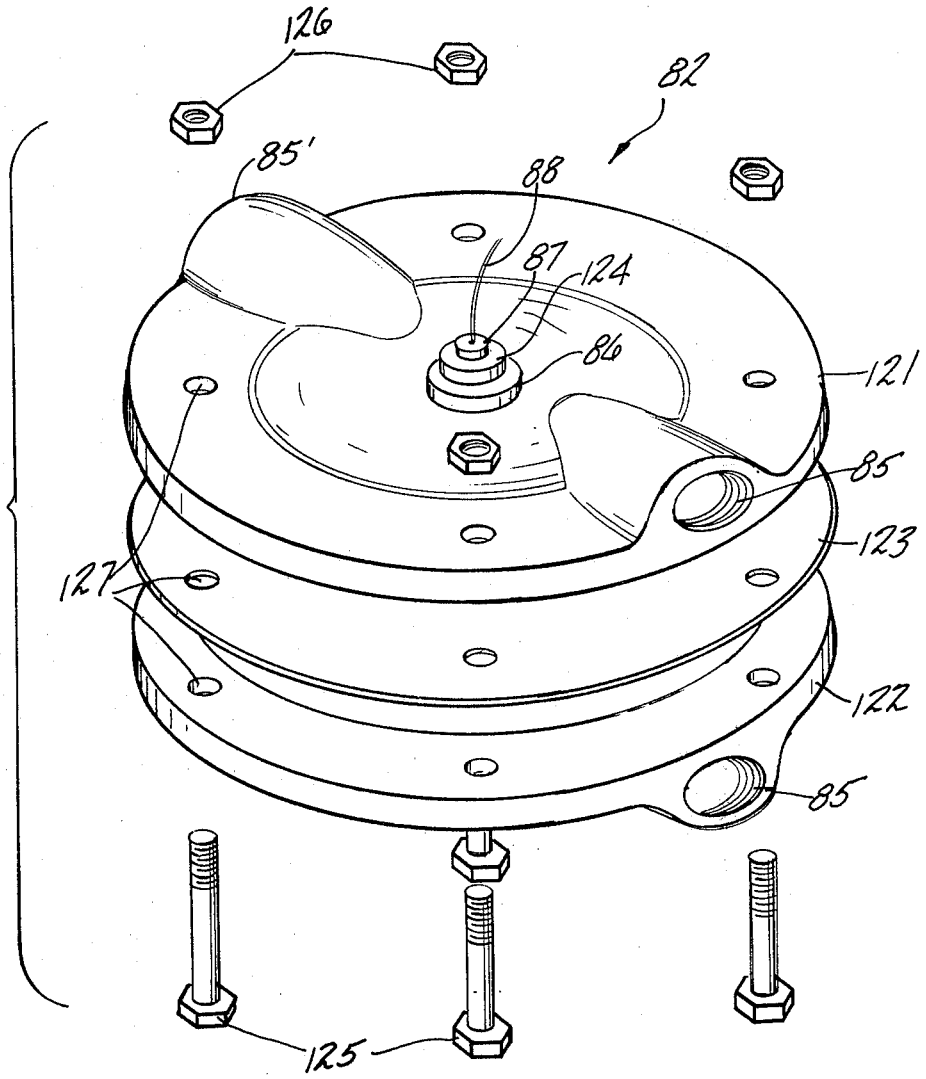
FIG. 12 is an exploded perspective view of a sensing device utilized in the strip center guide assembly shown in FIGS. 5 and 6.

Again referring to FIG. 5 air pressure pickup element 75 is secured via sleeves 76 to conduits 77. Conduits 77 are connected to flexible conduits 79 and are provided with elbows 78 to assist in ease of connection of the lines 79. Lines 79 are connected to a first set of peripheral ports 85 in sensing device 82, each of said first set of peripheral ports 85 being located on opposite sides of diaphragm 123. Pressure indicators or meters 84 are located in a second set of peripheral ports 85' and provide a ready measurement of the pressure on either side of diaphragm 123. Bracket 83 secures sensing device 82 to structural support 71. Sensing device 82 is also provided with a third set of ports 86, one on each side of diaphragm 123, whose axes are transverse to the plane of diaphragm 123. Secured within ports 86 are bushings 124 (FIG. 12). Adjustable contacts 87 are with wires 88 attached thereto are screw threaded into bushings 124.

FIG. 6 shows metal strip 1 passing around steering roll 8 and between air supply element 63 and air pressure pickup element 75 prior to passing through dryer 16 (FIGS. 2 and 3). Center guide system 60 is shown mounted to I-beam supports 52 of the furnace-quench tank structures to monitor the position of strip 1 on steering roll 8. Pressure differentials picked up by air pressure pickup element 75 are conveyed to sensing device 82 via flexible conduits 79 which converts such differentials into electrical signals transmitted via wires 88. The signals are directed to a control circuit 90 which activates a hydraulic amplifier 95. Hydraulic amplifier 95, in response to such activation provides a surge of fluid through fluid lines 41 to activate hydraulic cylinder 40 causing steering roll 8 to readjust and maintain strip 1 in the desired position.

Various control circuits and hydraulic amplifiers are well known and do not constitute a critical aspect of the center guide assembly 60 of the instant invention.

Figure 7:
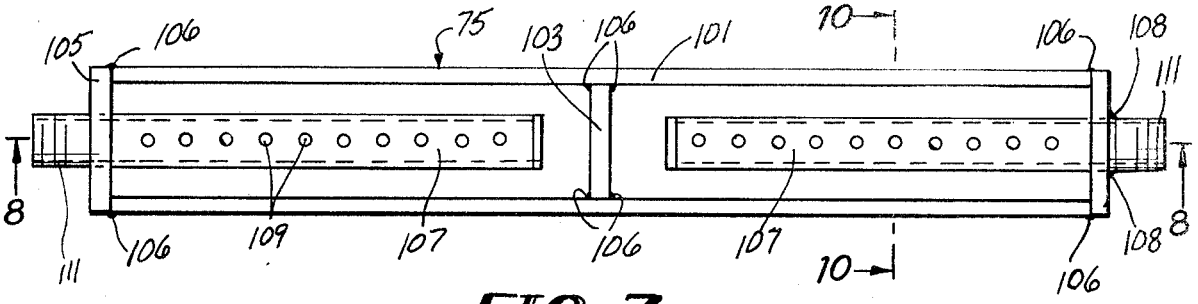
FIG. 7 is a top view of an air pressure pickup element utilized in the strip center guide assembly shown in FIGS. 5 and 6.
Figure 8:
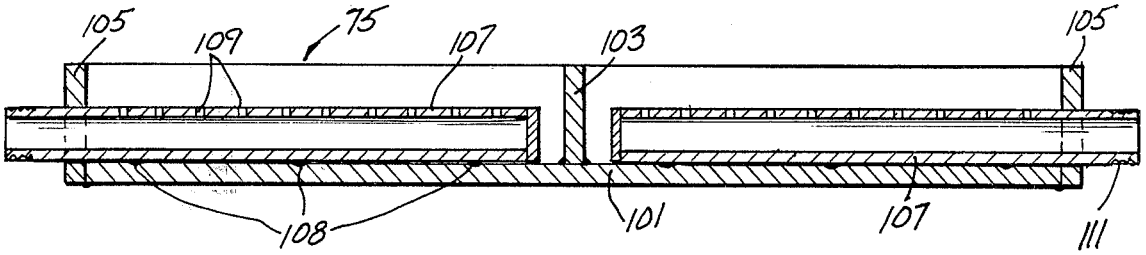
FIG. 8 is a cross-section taken through the line 8—8 in FIG. 7.
Figure 10:
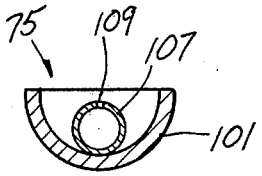
FIG. 10 is a cross-section taken through the line 10—10 in FIG. 7.

One embodiment of an air pressure pickup element 75 in accordance with this invention is shown in greater detail in FIGS. 7, 8 and 10. Pickup element 75 comprises an elongated air collector 101 of semi-circular cross-section. Intermediate wall 103 and end caps 105 are secured to air collector 101 by means of welds 106 or by any other suitable means. Pressure pickup conduits 107 pass through end caps 105 and are welded at points 108 to secure the conduits 107 to air collector 101. Pickup conduits 107 are provided with orifices 109 which are aligned in a row parallel to the axis of the conduits 107 and are further provided with threaded end 111 for attachment to conduits 77 (FIG. 5).

Figure 9:
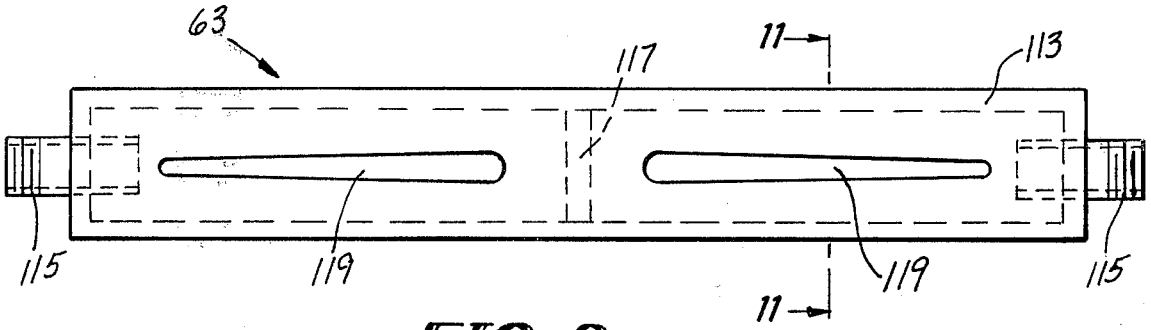
FIG. 9 is a top view of an air supply element utilized in the strip center guide assembly shown in FIGS. 5 and 6.
Figure 11:
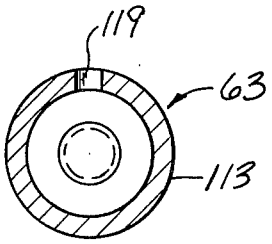
FIG. 11 is a cross-section taken through the line 11—11 in FIG. 9.

Referring now to FIGS. 9 and 11 there is depicted therein a preferred embodiment of air supply element 63. Air supply element 63 consists of a conduit 113 having an intermediate wall 117 and slits 119. Slits 119 are parallel to the axis of conduit 113. Threaded ports 115 are provided at each end of conduit 113 to provide for ready attachment of air supply element 63 to sources of air. During operation both ports 115 receive a substantially equal amount of air.

Orifices 109 of air pressure pickup element 75 preferably have a width approximately equal to those portions of slits 119 opposite therefrom. In addition, orifices 109 could vary in width. The important factor to control is that both the slits 119 and orifices 109 be symmetrical in both directions from walls 117 and 103, respectively.

It is also preferred to provide a taper to slits 119 since the further from ports 115 one goes, the less fluid flow which will eminate from supply element 63. Typical dimensions of slits 119 might be approximately 3/16" at the broad end thereof, tapering down to ⅛" at the narrow end, each slit running approximately 15". It would of course be possible to use a uniform width slit, and dimensions of approximately ⅛" have been found acceptable.

FIG. 12 shows a sensing device 82 to be made up of two facing shell halves 121 and 122 with a flexible diaphragm 123 interposed therebetween. Shell halves 121 and 122 and diaphragm 123 are provided with holes 127 for passage of securing bolts 125 therethrough. Sensing device 82 is fastened by bolts 125 and nuts 126. Each shell half 121 and 122 are provided with ports 86 having axes transverse to the plane of diaphragm 123. Two rubber bushings 124 (one shown) are secured within ports 86. Adjustably screwed within bushing 124 are two adjustable contacts 87 for providing electrical signals along wire 88 upon contact with diaphragm 123. Diaphragm 123 in constructed of a flexible material such as mylar or rubber which is rendered conductive by coating with a conductive paint. Alternatively, diaphragm 123 could be rendered conductive by mounting a conductive strip material thereon. Bushing 124 must act as an insulator and might typically be constructed of rubber of a like material.

Figure 13:
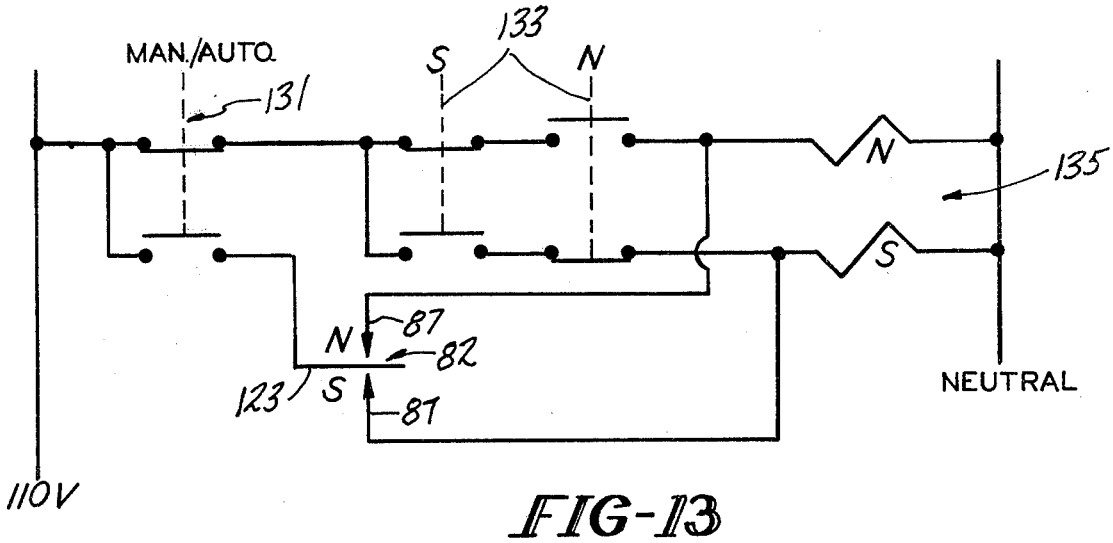
FIG. 13 is a circuit diagram of one embodiment of a control circuit utilized for transmitting an electric signal from the sensing device of FIG. 12 to an appropriate solenoid relay for properly activating the steering mechanism of this invention.
Figure 14:
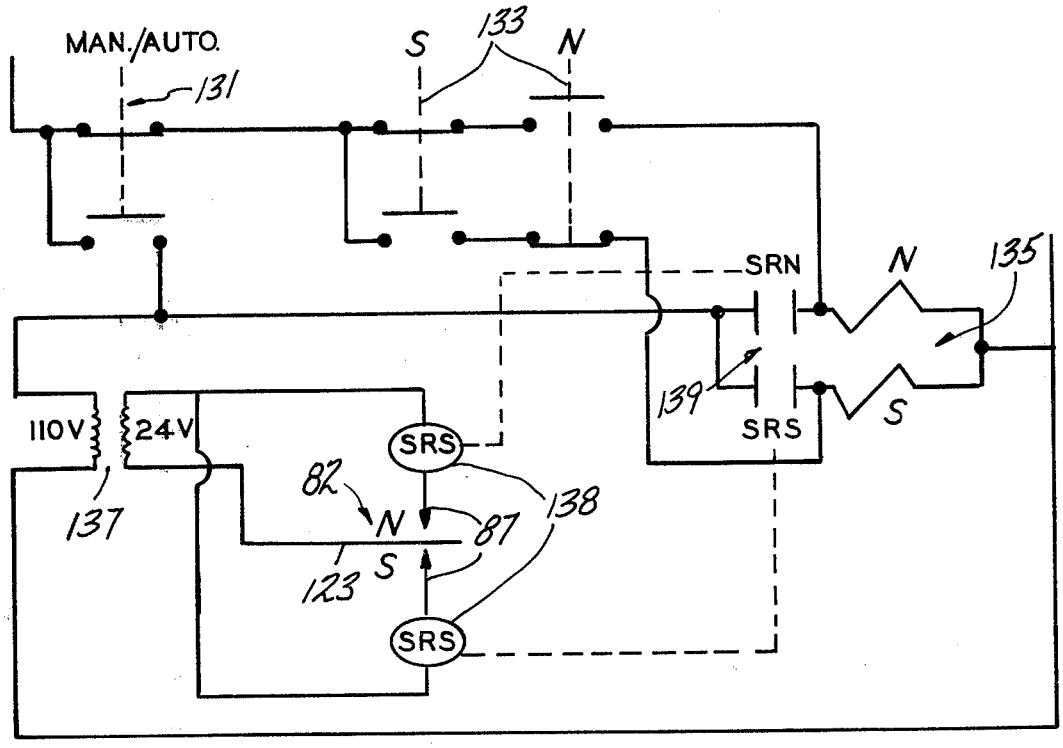
FIG. 14 is a circuit diagram similar to FIG. 13 showing a step-down transformer for providing a lower working voltage to the sensing device of FIG. 12.

FIGS. 13 and 14 represent embodiments of two control circuits which could be used with the center guide assembly of this invention. For purposes of clarity it will be assumed that when hydraulic cylinder 40 and thus steering roll 8 is activated it results, depending on the signal received from the control circuit, in a lateral movement of strip 1 in either a north (N) or south (S) direction across steering roll 8.

The circuit of FIG. 13 shows a 110 volt source attached to a manual/automatic selector switch 131. Switch 131 is shown in the manual mode and an operator can activate either a north (N) or south (S) solenoid valve 135 by selecting and throwing manually operated north (N) or south (S) switches 133, as desired. Solenoid valve coils 135 then activate hydraulic cylinder 40 via hydraulic amplifer 95 (FIG. 3) in a known manner to move strip 1 in the selected direction.

Setting manual/automatic selector switch 131 on automatic places steering roll 8 under automatic control of center guide assembly 60 of this invention. The circuit in FIG. 10 is then activated by sensing device 82 when as a result of a pressure differential between pressure pickup conduits 107 diaphragm 123 is flexed toward a north (N) or south (S) adjustable contact 87. Depending on which contact 87 is touched by diaphragm 123 either the N or S solenoid valve coils 135 activate hydraulic cylinder 40, as discussed previously.

It is desirable to put a lower voltage on the sensing device 82 to get less current flow through diaphragm 123. This helps to prevent arcing problems and more frequent service of diaphragm 123.

FIG. 14 depicts a circuit similar to FIG. 10, with a stepdown transformer 137 being interposed between manual/automatic selector switch 131 and sensing device 82. Contacts 87 of sensing device 82, upon making contact with diaphragm 123, operate coil operated relays 138 which are mechanically connected to contacts 139 thereby activating solenoid valve coils 135. FIG. 14 depicts a 110 volt-24 volt stepdown transformer and thus relays 138 would be 24 volt relays, SRN designating steering roll north and SRS designating steering roll south.

Calibration of sensing device 82 is accomplished as follows: with the power off and wiring removed from adjustable contacts 87, connect an ohm meter from either shell half 122 to adjustable contact 87 to be adjusted. Shut off air and pickup feed. Adjust contact 87 slowly until continuity is just indicated on meter, then back off until meter just indicates an open circuit. Adjust both contacts 87 in the same manner. When complete and wiring is reconnected, the sensing device 82 will be in its most sensitive state of calibration.

The operation of the center guide assembly 60 in conjunction with the steering mechanism of the invention is as follows: air pressure pickup element 75 and air supply element 63 are arranged in spanning relation to the path of travel of strip 1, and the center portion or walls 103 and 117 respectively thereof are arranged over the desired longitudinal center line path of strip 1. Upon running along this center line the strip 1 is considered to be centered. Air from supply element 63 is directed across the surface of moving strip 1, with only that air which passes over the edges of strip 1 effectively reaching pressure pickup element 75. Independent pressure pickup conduits 107 sense the air pressure and as the strip 1 moves off center (assuming a southward shift) a pressure differential develops, that is one pressure pickup conduit 107 experiences a greater air pressure than the other pressure pickup conduit 107. This pressure differential is conveyed to sensing device 82 via conduits 79 causing diaphragm 123 to deflect toward the low pressure side of sensing device 82 till it makes contact with an adjustable contact 87 (depicted N in FIG. 13). This contact causes activation of solenoid valve coil N which then activates hydraulic cylinder 40 via hydraulic amplifier 95 (FIG. 6) to rotate pivot arm 44 (FIG. 4) to tilt steering roll 8 and move the strip in the north direction, or back toward center. The operation of center guide assembly 60 is thus continuous and automatic, regardless of the width of strip 1. The only limitation on strip width is that the edges of the centered strip fall somewhere within the air pressure range established by slits 119 and orifices 109.

While the steering apparatus of this invention has been described in conjunction with a furnace and quench tank, it is to be understood that the mechanism will operate to steer strip material for any type of operation including among others strip supply, rolling, slitting, cleaning, winding, etc.

However, the steering apparatus of this invention does provide particular benefit when used in a limited space and/or hostile environment. Because the entire steering roll tilts rather than just one side, and because no jacks are used, as in prior art steering devices for such an application the steering mechanism of this invention provides a very fast response, is readily adaptable for use with an automatic edge guide control, requires very little space, and enables the maintaining of higher line speeds. An additional benefit of such a fast response is the ability of the mechanism to tolerate reasonably substantial amounts of bearing wear and/or use of non-precision bearings. The steering mechanism of this invention is also readily serviceable. As can be seen from FIG. 3 the pillow block bearing can be greased even when quench tank 12 is filled with water.

In addition, steering roll 8 can be easily removed and replaced by simply emptying the quench tank 12, supporting the roll, and removing bolts 26 thereby releasing lower split bearing portion 24 and thus roll shaft 25 and steering roll 8.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a continuous strip annealing apparatus having a heating zone and a quench tank for heating and quenching a supply of strip material, the improvement comprising:

roll means located within and free from contact with the walls of said tank for steering said strip material; and means attached to said roll for holding and tilting said roll, whereby upon tilting of said roll said strip material is caused to move in a direction parallel to the axis of said roll.

2. The continuous strip annealing apparatus according to claim 1 wherein said means for holding and tilting comprises a pivotable yoke.

3. The continuous strip annealing apparatus according to claim 2 wherein said yoke includes an upper suspension portion, said portion being rigidly secured to a means for pivoting said yoke.

4. The continuous strip annealing apparatus according to claim 3 wherein said yoke includes two lower suspension arms, each having one end attached to said upper suspension portion, and the other end attached to respective portions of a first shaft, said first shaft being attached to said roller and constituting the axis of rotation of said roller.

5. The continuous strip annealing apparatus according to claim 4 wherein said pivoting means comprises a second shaft arranged for rotation.

6. The continuous strip annealing apparatus according to claim 5 including means attached to said second shaft for rotating said second shaft.

7. The continuous strip annealing apparatus according to claim 6 wherein said means for rotating includes a hydraulic activating means.

8. The continuous strip annealing apparatus according to claim 7 wherein said means for rotating includes a pivot arm rigidly attached at one end of said second shaft, said pivot arm being clevis mounted at the other end to a cylinder shaft of said hydraulic activating means.

9. A steering mechanism for steering a continuous strip of material comprising a roll mounted to a first shaft and a pivotable yoke attached to said shaft whereby upon pivoting of said yoke said roll is caused to tilt thereby providing a movement of said strip material in a direction parallel to the axis of said roll.

10. A steering mechanism according to claim 9 wherein said yoke includes an upper suspension portion said portion being rigidly secured to a means for pivoting said yoke.

11. A steering mechanism according to claim 10 wherein said yoke includes two lower suspension arms, each having one end attached to said upper suspension portion and the other end attached to respective ends of said first shaft.

12. A steering mechanism according to claim 11 wherein said pivoting means comprises a rotatable shaft.

13. A steering mechanism according to claim 12 including a means attached to said rotatable shaft for rotating said shaft.

14. A steering mechanism according to claim 13 wherein said means for rotating includes a hydraulic activating means.

15. A steering mechanism according to claim 14 wherein said means for rotating comprises a pivot arm rigidly attached at one end to said rotatable shaft, said pivot arm being clevis mounted at the other end to a cylinder shaft of said hydraulic activating means.

16. A steering mechanism and center guide assembly for automatically steering a moving strip material along a desired path of travel comprising:

roll means mounted to a first shaft;

pivotable yoke means for tilting said roll means, said pivotable yoke means being attached to said shaft;

means connected to said yoke for pivoting said yoke upon activation;

activating means connected to said pivoting means for causing tilting of said roll means upon receipt of an appropriate signal;

means on one side of and extending beyond both edges of said strip for continuously supplying a flow of air across said path of travel of said strip material;

means on the other side of said strip for collecting two separate portions of said flow of air, said separate portions each passing and being associated with one of said edges; and means connected to said collecting means for sensing any pressure differential between said separate portions of said flow of air and for providing said signal in response to said pressure differential.

17. A steering mechanism and center guide assembly according to claim 16 wherein said means for continuously supplying a flow of air comprises an air supply element, said air supply element including a conduit having an intermediate wall therein and at least two slits in the outer surface thereof, at least one of said slits being located on each side of said wall, said slits being aligned and parallel to the axis of said conduit, and said slits being of equal dimension at equal distances from said wall.

18. A steering mechanism and center guide assembly according to claim 17 wherein said conduit is provided with ports at each end thereof for attachment to two air sources.

19. A steering mechanism and center guide assembly according to claim 18 wherein said slits are tapered such that the ends of said slits closest to said wall are wider than the ends of said slits closest to said ports.

20. A steering mechanism and center guide assembly according to claim 16 wherein said means for collecting said separate portions of said flow of air comprises an air pressure pickup element, said pickup element including at least two pressure pickup conduits, each of said conduits having at least two orifices in the outer surface thereof, said orifices being aligned and parallel to the axis of said pressure pickup conduits.

21. A steering mechanism and center guide assembly according to claim 20 wherein said means for collecting said separate portions of said flow of air includes an elongated scoop shaped air collector having an intermediate wall perpendicular to the axis thereof, said conduits being located on opposite sides of said wall within said scoop shaped air collector, said orifices being parallel to and substantially opposite from the closed end of said scoop shaped air collector.

22. A steering mechanism and center guide assembly according to claim 21 wherein said conduits have one closed end and one open end, said open end having means for connection to said means for sensing any pressure differential between said separate portions of said flow of air.

23. A steering mechanism and center guide assembly according to claim 16 wherein said means for sensing any pressure differential between said separate portions of said flow of air and for providing a signal comprises a sensing device, said sensing device including a conductive diaphragm mounted between two shell halves.

24. A steering mechanism and center guide assembly according to claim 23 wherein said means for collecting said separate portions of said flow of air comprises an air pressure pickup element, said pickup element including at least two pressure pickup conduits having means for connection to said sensing device.

25. A steering mechanism and center guide assembly according to claim 24 wherein said shell halves each include at least one peripheral port for connection to one of said pressure pickup conduits.

26. A steering mechanism and center guide assembly according to claim 25 wherein said shell halves each include a face port, said face port having an axis transverse to the plane of said diaphragm.

27. A steering mechanism and center guide assembly according to claim 26 including an insulator bushing located within said face port, said insulator bushing having an adjustable contact mounted therein.

28. A steering mechanism and center guide assembly according to claim 27 wherein said adjustable contact is screw threaded.

29. A steering mechanism and center guide assembly according to claim 26 wherein said shell halves each include a second peripheral port, said second peripheral port having a pressure indicator secured therein.

30. A steering mechanism and center guide assembly according to claim 27 including two solenoid valve coils, each of said coils being electrically connectable to said adjustable contacts upon deflection of said diaphragm.

31. A steering mechanism and center guide assembly according to claim 23 wherein said conductive diaphragm is constructed of a material selected from the group consisting of rubber or mylar, said material having a conductive coating thereon.

32. A steering mechanism and center guide assembly according to claim 31 wherein said conductive coating is painted on said diaphragm.

33. A steering mechanism and center guide assembly according to claim 31 wherein said conductive coating is a conductive strip adhesively secured to said diaphragm.

* * * * *

UNITED STATES PATENT AND TRADEMARK OFFICE

CERTIFICATE OF CORRECTION

PATENT NO. : 4,322,060

DATED : March 30, 1982

INVENTOR(S) : Bennett W. DeBiase, Harold W. Ryder, Pasquale Silvestri, and John M. Whalen It is certified that error appears in the above—identified patent and that said Letters Patent is hereby corrected as shown below:

In the cover page, line 2, "Debiase et al." should read --DeBiase et al.--;

In the cover page, line 5, "Bennet W. Debiase" should read --Bennett W. DeBiase--.

In column 1, line 16, "jamb" should read --jam--.

In column 3, line 18, "therealong" should read --there along--.

In column 4, line 2, "treaded" should read --threaded--;

In column 4, line 2, "thorugh" should read --through--.

In column 5, line 2, "cyliner" should read --cylinder--;

In column 5, line 20, "pheumatic" should read --pneumatic--;

In column 5, line 25, "stering" should read --steering--.

In column 6, line 23, the word "are" should be deleted.

UNITED STATES PATENT AND TRADEMARK OFFICE

CERTIFICATE OF CORRECTION

PATENT NO. : 4,322,060

DATED : March 30, 1982

INVENTOR(S) : Bennett W. DeBiase, Harold W. Ryder, Pasquale Silvestri, and John M. Whalen It is certified that error appears in the above—identified patent and that said Letters Patent is hereby corrected as shown below:

In column 7, line 25, "in" should read —is—;

In column 7, line 31, "of" should read —or—.

Signed and Sealed this

*Thirteenth* Day of *July 1982*

[SEAL]

*Attest:*

GERALD J. MOSSINGHOFF

*Attesting Officer*

*Commissioner of Patents and Trademarks*